US009415297B2

(12) United States Patent
Lando

(10) Patent No.: US 9,415,297 B2
(45) Date of Patent: Aug. 16, 2016

(54) MATHEMATICAL PUZZLE GAME

(76) Inventor: Mordechai Lando, Beer-Sheva (IL)

( * ) Notice: Subject to any disclaimer, the term of this patent is extended or adjusted under 35 U.S.C. 154(b) by 1514 days.

(21) Appl. No.: 12/514,829

(22) PCT Filed: Nov. 1, 2007

(86) PCT No.: PCT/IL2007/001340

§ 371 (c)(1),
(2), (4) Date: May 14, 2009

(87) PCT Pub. No.: WO2008/062399

PCT Pub. Date: May 29, 2008

(65) Prior Publication Data

US 2010/0025929 A1 Feb. 4, 2010

(30) Foreign Application Priority Data

Nov. 19, 2006 (IL) ..... 179388

(51) Int. Cl.
*A63F 9/10* (2006.01)
*A63F 3/04* (2006.01)
*A63F 3/00* (2006.01)

(52) U.S. Cl.
CPC ..... *A63F 3/0415* (2013.01); *A63F 3/0457* (2013.01); *A63F 2003/00757* (2013.01)

(58) Field of Classification Search
CPC ..... A63F 3/0415; A63F 2003/00757; A63F 3/0457
USPC ..... 473/153 R, 157 R, 272, 153 J
See application file for complete search history.

(56) References Cited

U.S. PATENT DOCUMENTS

| | | | | | |
|---|---|---|---|---|---|
| 368,484 | A | * | 8/1887 | Niggemann | 273/153 S |
| 481,589 | A | * | 8/1892 | Proctor | 273/153 J |
| 854,547 | A | * | 5/1907 | Werner | 273/156 |
| 930,151 | A | * | 8/1909 | Brown | 273/153 R |
| 1,068,449 | A | * | 7/1913 | Reeder | 273/153 J |
| 1,432,062 | A | * | 10/1922 | Greene | 273/153 R |
| 1,457,383 | A | * | 6/1923 | Miller | 273/153 R |
| 1,550,230 | A | * | 8/1925 | Taylor | 273/153 R |
| 1,554,910 | A | * | 9/1925 | Fitzsimons | 273/153 S |
| 1,561,098 | A | * | 11/1925 | Meehan | 273/153 R |
| 1,959,040 | A | * | 5/1934 | Schilling | 273/153 R |
| 2,170,909 | A | * | 8/1939 | Moren | 273/153 S |
| 3,189,350 | A | * | 6/1965 | Hopkins | 273/153 R |
| 4,128,243 | A | * | 12/1978 | Pulejo | 273/156 |
| 4,687,207 | A | * | 8/1987 | Darling | 273/271 |
| 5,156,548 | A | * | 10/1992 | Grafflage | 273/153 R |
| 6,206,372 | B1 | | 3/2001 | Harris | |
| 6,378,866 | B1 | * | 4/2002 | Graham-Ward | 273/153 R |
| 2011/0018196 | A1 | * | 1/2011 | Cabrera | 273/153 R |

* cited by examiner

*Primary Examiner* — Steven Wong

(57) ABSTRACT

The invention provides a puzzle game comprising a background defining a graph (40, 80, 1 10), having nodes (44, 46, 82, 84) connected by lines, or a diagram having sites or nodes, and elements (51-59, 102, 104, 106) having a plurality of indices disposed thereon. The background is metallic or non-metallic board, and the game might be implemented on an electronic game apparatus or on a computer system. The elements are removably disposable on the graph nodes. The indices are of one of up to three distinct types. An arrangement of the elements disposed on the graph nodes defines a magic graph so that patterns of the magic graph are characterized by having a first relationship and a second relationship. The graph may be a triangle, a hexagram, a heptagram, a tri-trapezoid shape, or other shape which is substantially symmetric under a rotation. The indices might be numbers, colors, domino-like groups of dots, symbols, or a geometric structure.

9 Claims, 14 Drawing Sheets

| | | |
|---|---|---|
| 6 | 1 | 8 |
| 7 | 5 | 3 |
| 2 | 9 | 4 |

Fig. 1c Prior art

| | | |
|---|---|---|
| Cβ | Aα | Bγ |
| Aγ | Bβ | Cα |
| Bα | Cγ | Aβ |

Fig. 1d Prior art

MATHEMATICAL PUZZLE GAME

RELATED APPLICATIONS

This patent application is a U.S. National Phase Application of PCT/IL2007/001340 filed 1 Nov. 2007, which also claims the benefit of IL 179388 filed on Nov. 19, 2006 the contents of which are incorporated herein by reference.

TECHNICAL FIELD

The invention is in the field of gifts, souvenirs and ornaments which are especially designed for certain people or groups of people. The invention is also strongly related to puzzle games, jigsaw games and mathematical recreation quizzes, and may be used in various kinds of computerized systems.

BACKGROUND ART

The present invention adopts well known mathematical games of prior art, and provides their use in gifts, souvenirs, and ornaments, broadening mathematical game principle of operation in relation to graphics, number relationships, etc. FIG. 1 presents three examples of the prior art. FIG. 1*a* illustrates a paper-and-pencil game consisted of a triangular graph with four nodes on a side, which hereafter are designated by a side pattern. Initially the nodes are empty and the player is asked to fill in the numbers 1 to 9 in such a way that an equal sum is obtained upon addition of all the numbers on each side pattern. FIG. 1*a* shows a solution with 17 as the equal sum number. Other equal sum arrangements are possible as well, with either 17 or other number as the equal sum number.

FIG. 1*b* presents a magic pentagram, or star of fifth order, having five valley nodes and five vertex nodes, wherein a number appears at every node. The number arrangement provides a magic pentagram so that five straight-line-patterns have a relationship that an identical sum is obtained upon addition of all the numbers which appear on the nodes of said straight-line-pattern.

A two thousand years old prior art is shown in FIG. 1*c*, a 3×3 magic square, whereas a sum of 15 is obtained upon addition of a number triplet which appears in a row pattern or in a column pattern. In general, the challenge of N×N magic square is to get the equal sum arrangement using consecutive numbers, classically 1 to $N^2$, without repetitions. Famous mathematician Euler and his followers have shown that for most of the natural numbers N, several of the magic square solutions may be obtained using the concepts of Latin and Graeco-Latin symbol arrangement. Those concepts are clearly defined in U.S. Pat. No. 3,189,350 (issued Jun. 15, 1965) to Hopkins:

> "In the Latin square . . . having N squares on a side, a series of N symbols, such as Latin letters, are so arranged that no symbol occurs twice in any row or in any column. Many such arrangements are possible, and from this evolved a more complicated square in which two different arrangements of Latin squares are superimposed so that two symbols appear in each small square. It is a consequence of this arrangement that in addition to the two different solutions of the Latin square, a further solution is provided in that no two-symbol combination appears twice in any row or in any column. As a convenience the two Latin squares are made up from two different families of symbols, such as Greek letters and Latin letters, from which the term Graeco-Latin arises . . . ".

In other words, Graeco-Latin arrangement of N×N square simultaneously provides for three relationships:

1. The indices of a first type of indices are Latin arranged.
2. The indices of a second type of indices are Latin arranged.
3. No combination of an index of the first type of indices and an index of the second type of indices appears twice in the whole N×N square.

FIG. 1*d* presents a Graeco-Latin of the A, B, C Latin letters and the α,β, γ Greek letters. Once that arrangement is achieved, the numbers in the magic square of FIG. 1*c* are obtained upon execution of three steps:

1. Replacement of the Latin letters A, B, C with 1, 2,3, respectively.
2. Replacement of the Greek letters α,β, γ by 0,3,6, respectively.
3. Addition of every number corresponding to a Latin letter in a small square to the respective number corresponding to the Greek letter in the same small square.

Weekend newspaper editions suggest a Sudoko challenge, in which one has to complete absent 1-9 numbers in a 9×9 square, in order to obtain both a 9×9 Latin square arrangement over row and column patterns, and a Latin arrangement over nine 3×3 square patterns. Sometimes, several Sudoko challenges are being offered in a varying level, covering a full spectrum of newspaper reader ability.

U.S. Pat. No. 4,128,243 (issued Dec. 5, 1978) to Pulejo describes a magic square puzzle composed of five pieces which should be arranged in a 4×4 Latin square of the four domino-like indices of one to four dots.

U.S. Pat. No. 6,206,372 (issued Mar. 27, 2001) to Harris deals with a 5×5 magic square puzzle game and suggests element coloring to facilitate a desired magic square solution.

OBJECTS OF THE PRESENT INVENTION

It is an objective of the present invention to use magic squares and magic stars, as well as other graphs and diagrams, in the realm of laymen by their embodiment in gifts, souvenirs, ornaments, and toys.

Another objective of the present invention is to relax the mathematical challenge of the classical magic square and star and bring it down to a level suitable for broader groups of people. Yet another objective of the present invention is to replace the regularly ordered numbers and indices of the prior art by significant symbols and numbers in such a way that the whole item becomes meaningful to one getting it as a gift, a souvenir, an ornament, or a toy.

Another objective of the present invention is to introduce the application of a closed pattern, especially a corner pattern, in addition to the straight line and open patterns of the prior art.

DISCLOSURE OF INVENTION

The present invention provides a puzzle game comprising a background defining a graph, having a plurality of nodes connected by a plurality of lines or a diagram having a plurality of sites or nodes, and a plurality of elements having a plurality of indices disposed thereon. Said elements are removably disposable on the graph nodes. Said indices are of a first type of indices, or of a second type of indices, or of a third type of indices, said types of indices being distinct. An arrangement of said plurality of elements disposed on said graph nodes defines a magic graph so that at least three patterns of the magic graph are characterized by having a first relationship and a second relationship, whereas each of said patterns having equal number of nodes. Said first relationship is in accordance with the indices of the first type of indices disposed on said elements. Said second relationship is either in accordance with the indices of the second type of indices, or is in accordance with the indices of both the second and the third types of indices.

The background is a board, either metallic or non-metallic, or an ornament. For non-metallic board, the elements might be cardboard, wood or plastic material. For metallic board, the elements might be metallic elements which are magnetically attracted to the graph nodes. Said background and elements might be implemented on an electronic game apparatus or on a computer system. Said graph may be the equilateral triangle of FIG. 1*a*, a pentagram, a hexagram, a heptagram, a tri-trapezoid shape, or other shape which is substantially symmetric under a rotation.

The indices might be numbers, colors, domino-like groups of dots, or symbols. They also might be shapes like a round disk, a triangle, a square, a pentagon, a hexagon, a pentagram, or a hexagram. Said patterns might include a continuous series of adjacent nodes whereas a line connects each pair of adjacent nodes of that pattern. Said series might be closed with two adjacent nodes line-connected to each node of the pattern, or open, wherein all but two of the nodes have two adjacent nodes line-connected to each node of the pattern, while two nodes have only one line-connected adjacent node.

The first type of indices might be numbers, and said first relationship might be that whenever certain mathematical operation is executed upon the numbers disposed on all elements disposed on each said pattern, same result number is obtained. Said certain mathematical operation may be addition or multiplication. The result number may be significant to a certain group of people, so that the game is suitable to be a gift or souvenir for members or sympathizers of said certain group of people. In particular, the result number may be 12, 13, 16,18, 20,25,26, 30,40,50, 60, or 75, making the game especially suitable for someone celebrating a birthday or an anniversary, or for some country or organization celebrating the number of years since independence of said country or establishment of said organization, respectively.

The graph or the symbolic indices might resemble a religious symbol or a national symbol, especially a symbol which appears in a national flag or emblem. An arrangement may make use of all said elements or only major portion of them. A possible second relationship might be that the elements are Latin arranged with regard to the second type of indices, or Graeco-Latin arranged with regard to the second and third type of indices.

Rather than one arrangement fulfilling two relationships, it is possible to have a first arrangement with a first set of patterns fulfilling a first relationship and a second arrangement with a second set of patterns fulfilling a second relationship. Further features and advantages of the present invention will be apparent from the description bellow of several preferred embodiments.

BRIEF DESCRIPTION OF THE DRAWINGS

The invention is herein described, by way of example only, with reference to the accompanying drawings, which illustrate several preferred embodiments of the invention.

Prior Art

FIG. 1*c* (prior art) A 3×3 magic square with nine numbers disposed on nine sites with equal sum in each row or column pattern.

FIG. 1*d* (prior art) A Graeco-Latin arrangement on a 3×3 magic square.

A First Preferred Embodiment: A Sweet-Sixteen Tri-Trapezoid Puzzle

Figure 1A:
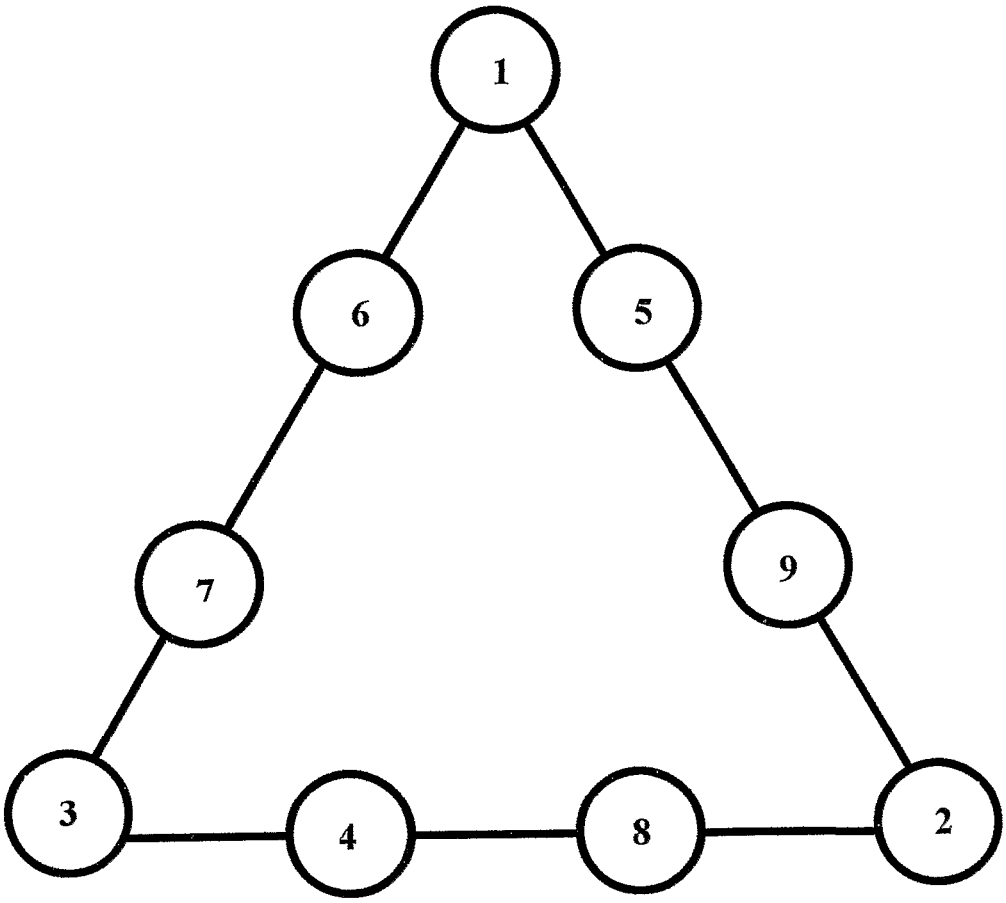
Fig. 1a Prior art
FIG. 1*a* (prior art) A triangle graph with nine numbers disposed on nine nodes with equal sum at each side.
Figure 1B:
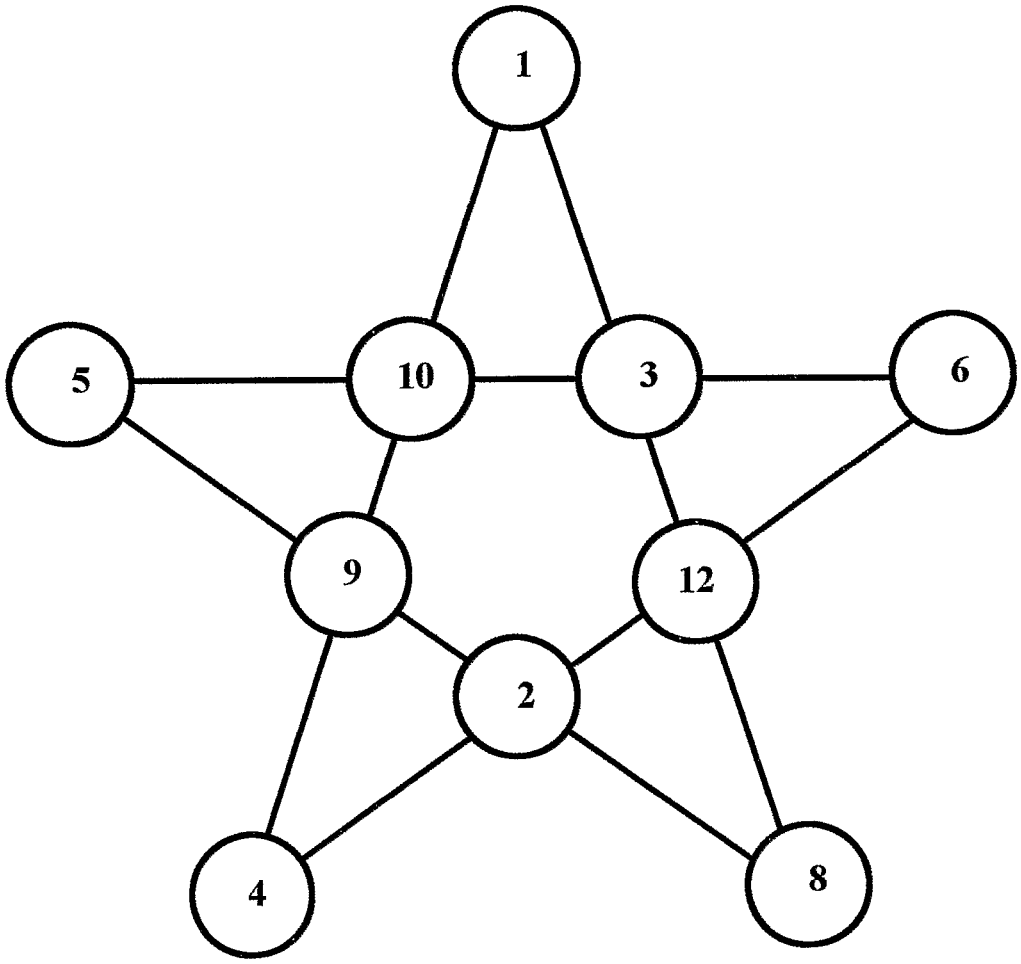
Fig. 1b Prior art
FIG. 1*b* (prior art) A pentagram graph with ten numbers disposed on ten nodes with equal sum along each straight line pattern.
Figure 2A:
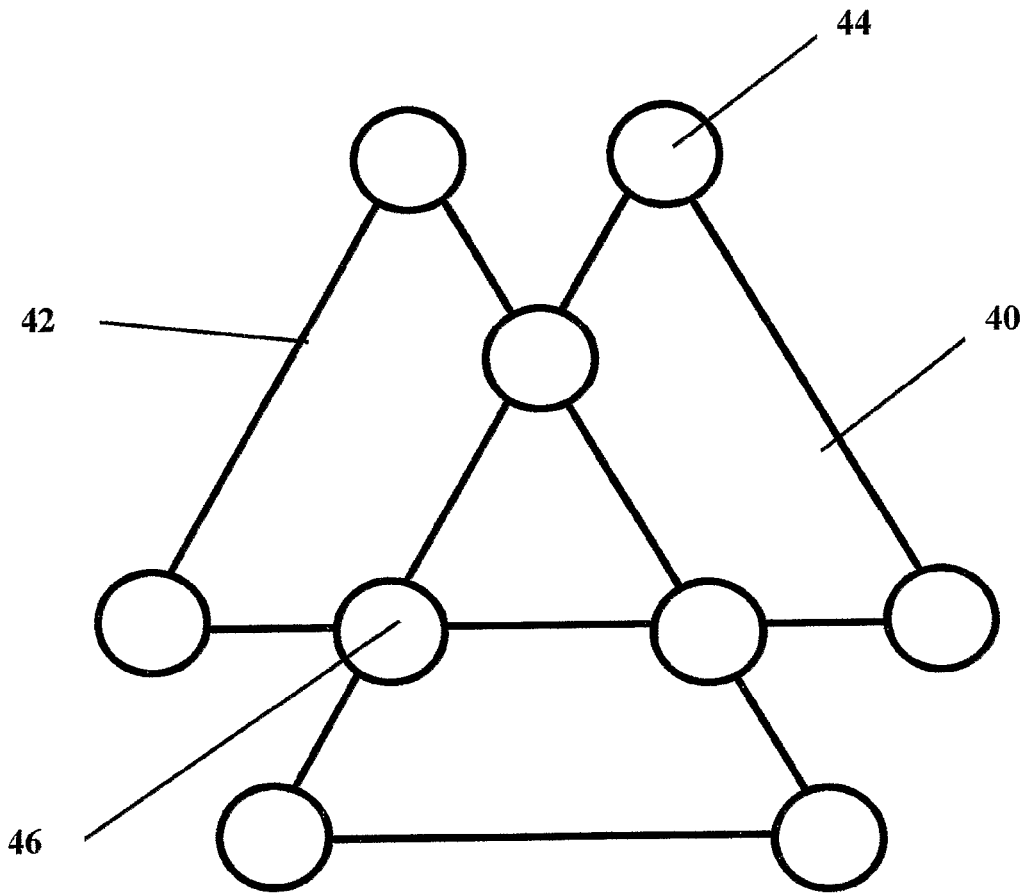

FIG. 2*a* A tri-trapezoid graph with three valley nodes and six vertex nodes.

Figure 2B:
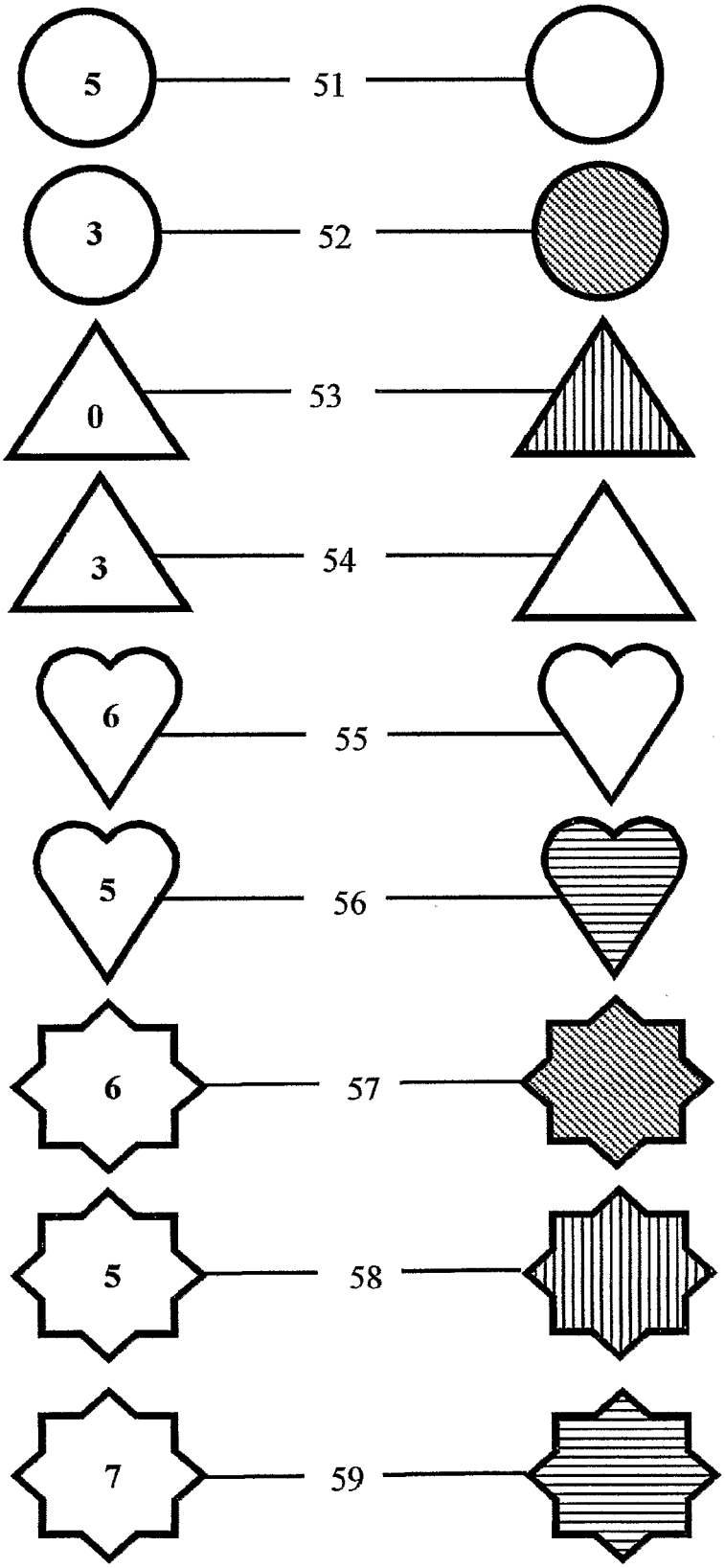

FIG. 2*b* A set of nine flat elements showing shape and texture indices on one side(right), and shape and number indices on the second side(left).

Figure 2C:
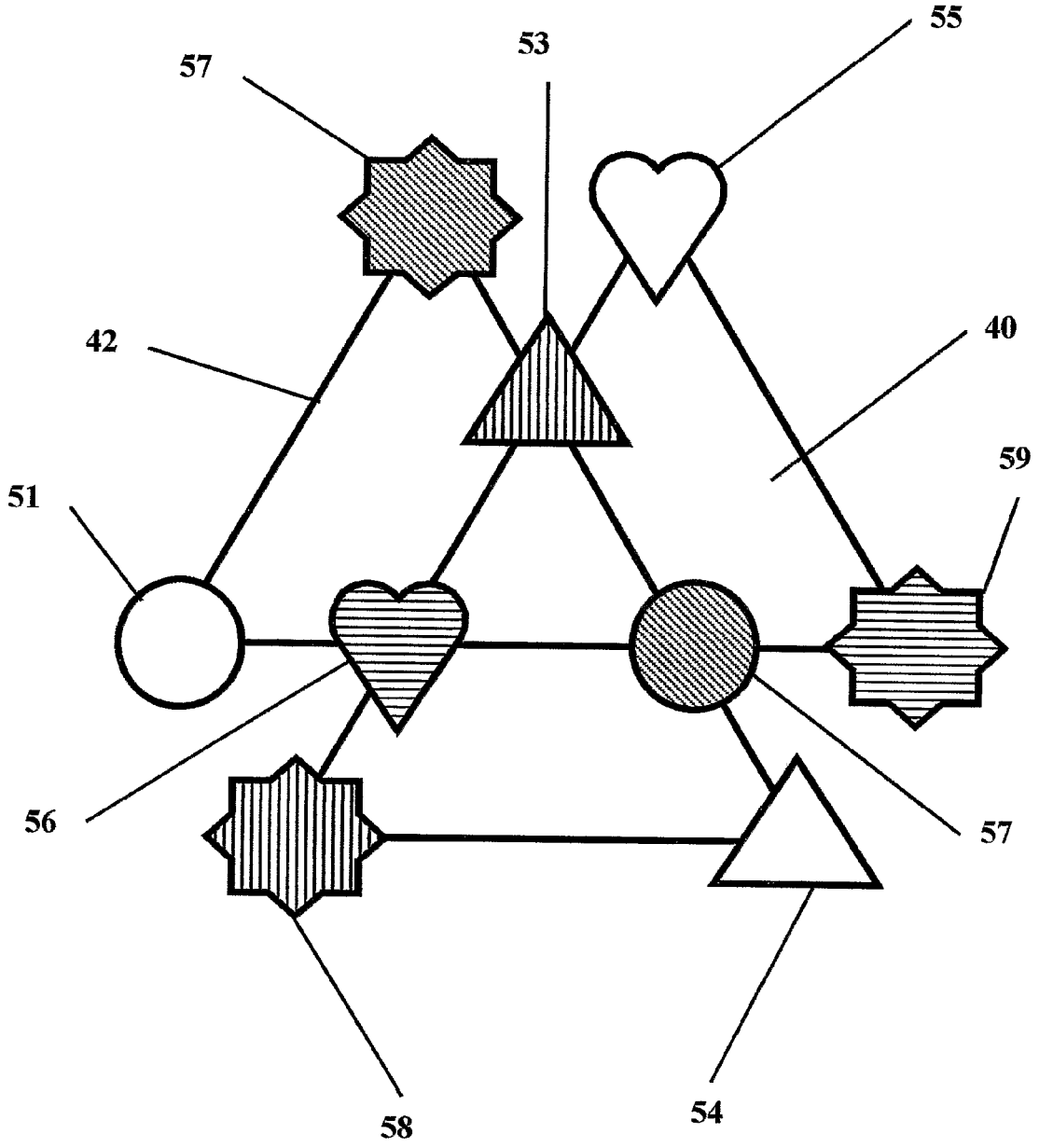

FIG. 2*c* A tri-trapezoid graph with nine elements disposed on nine nodes in a Graeco-Latin arrangement over trapezoid patterns.

Figure 2D:
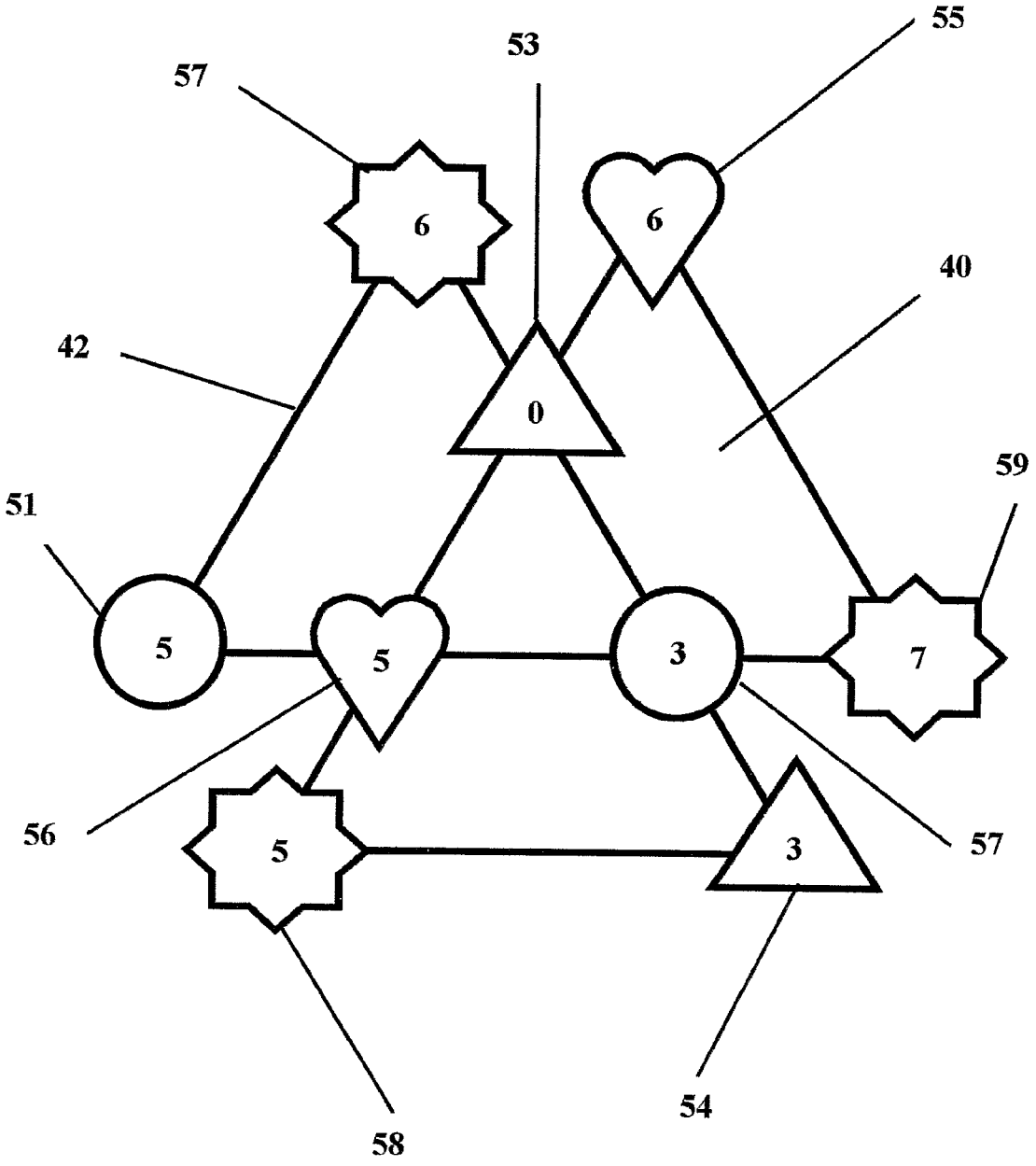

FIG. 2*d* The tri-trapezoid graph with element shape and number side up, showing a sum of 16 for every trapezoid pattern.

A Second Preferred Embodiment: A 7-Eleven Magic Star Puzzle

Figure 3A:
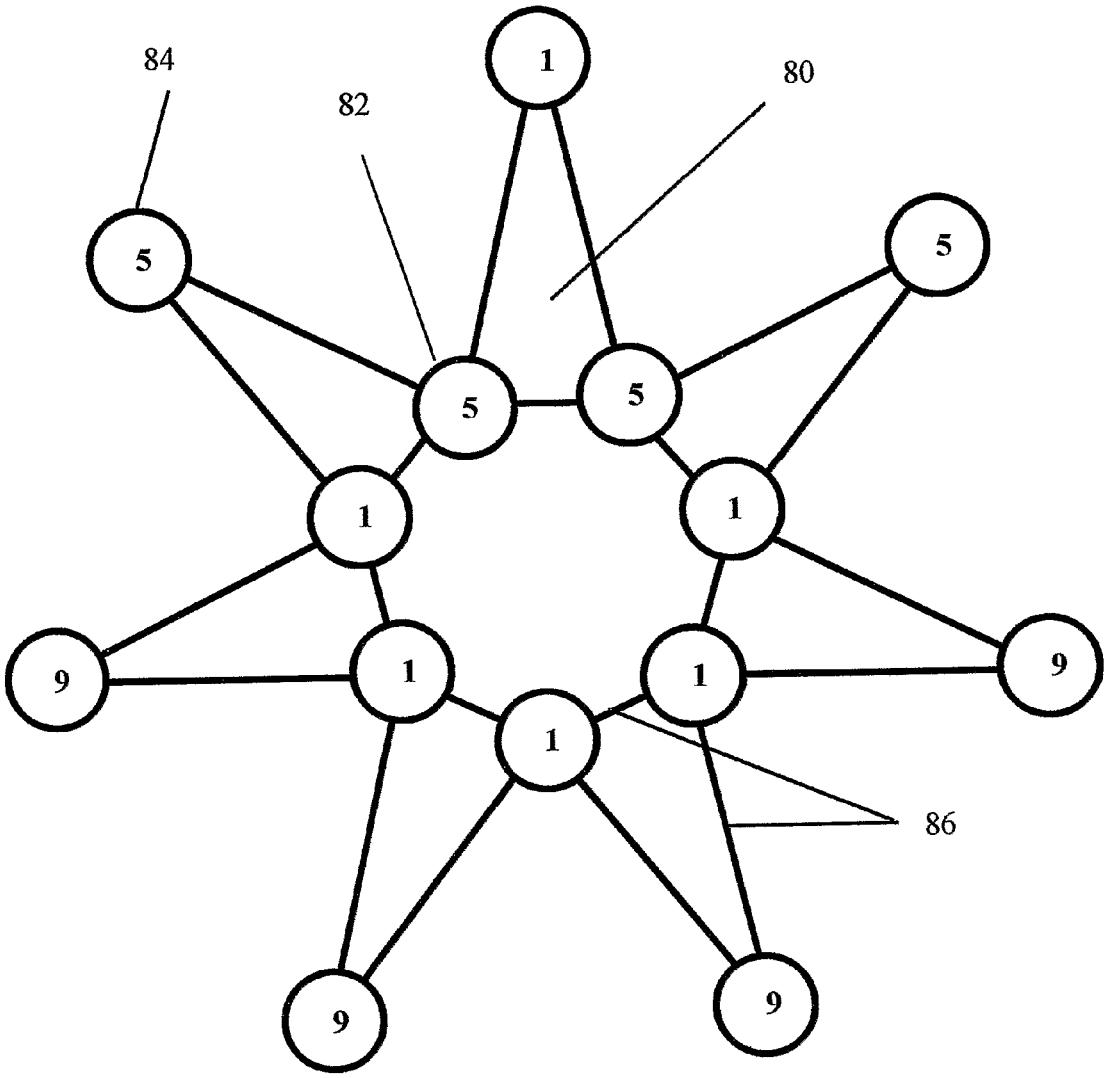

FIG. 3*a* A heptagram graph with elements arranged to give a sum of eleven for every number triplet disposed on a corner triangle pattern.

Figure 3B:
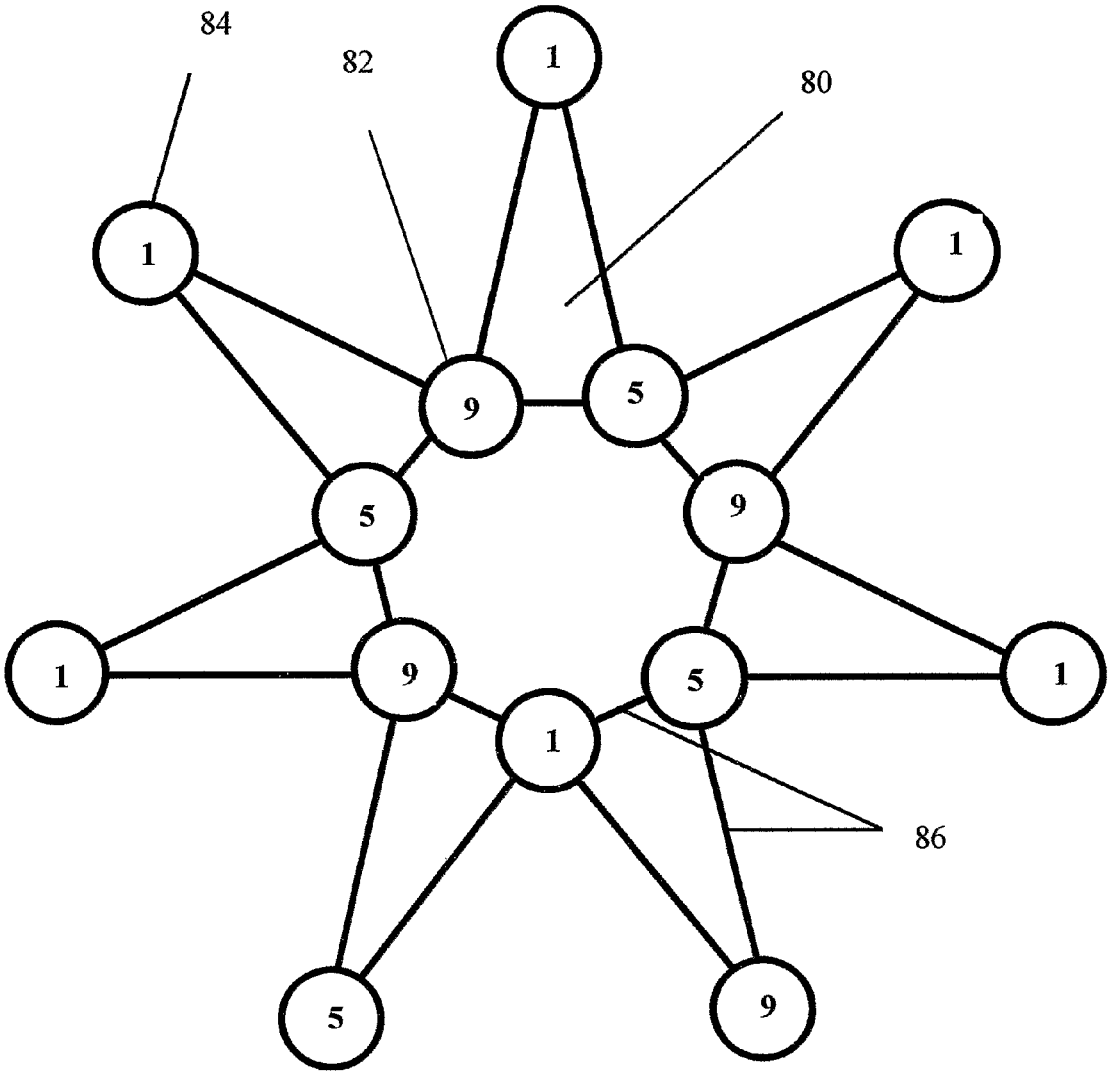

FIG. 3*b* The heptagram graph with elements arranged differently with a sum of 15 for every number triplet disposed on a corner triangle pattern.

A Third Preferred Embodiment: A Bar-Mitzvah Magic Solomon Seal

Figure 4A:
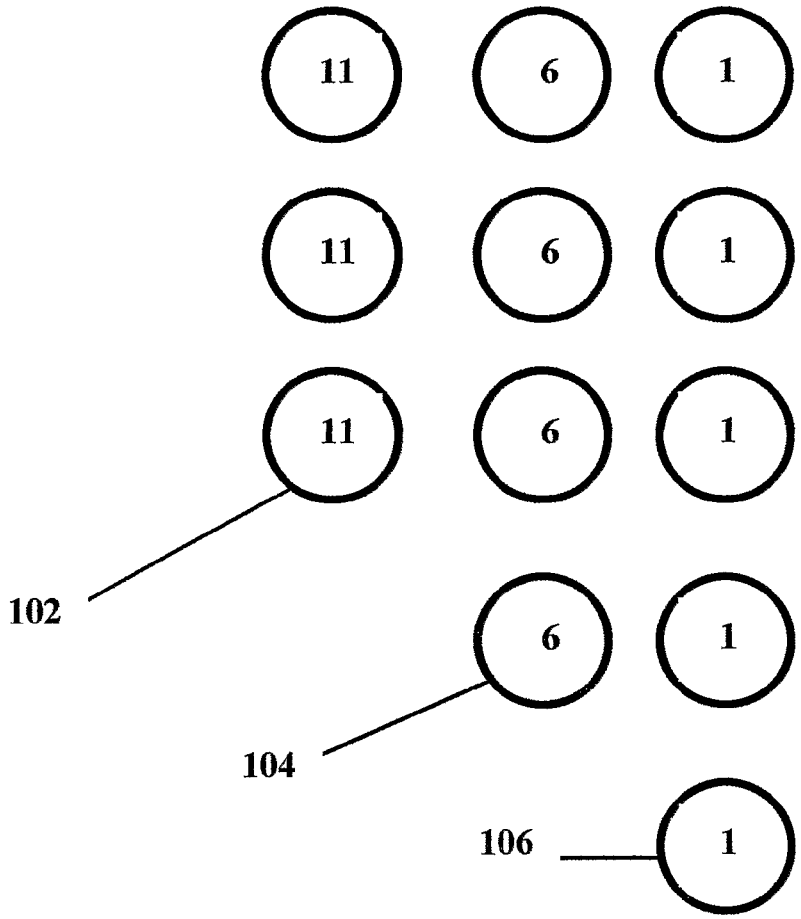

FIG. 4*a* A set of 12 flat elements of three kinds with their numerical side up.

Figure 4B:
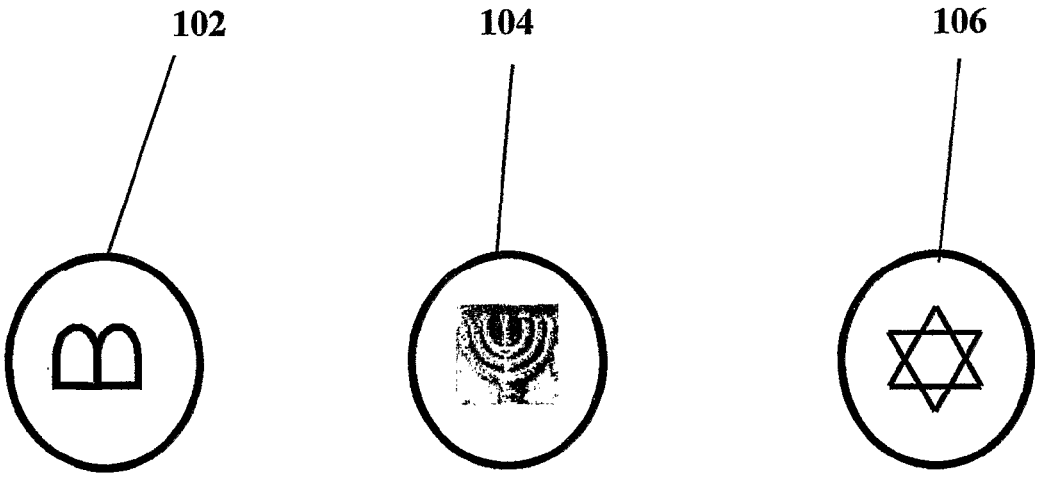

FIG. 4*b* Enlarged view of the three kind elements with their symbolic side up.

Figure 4C:
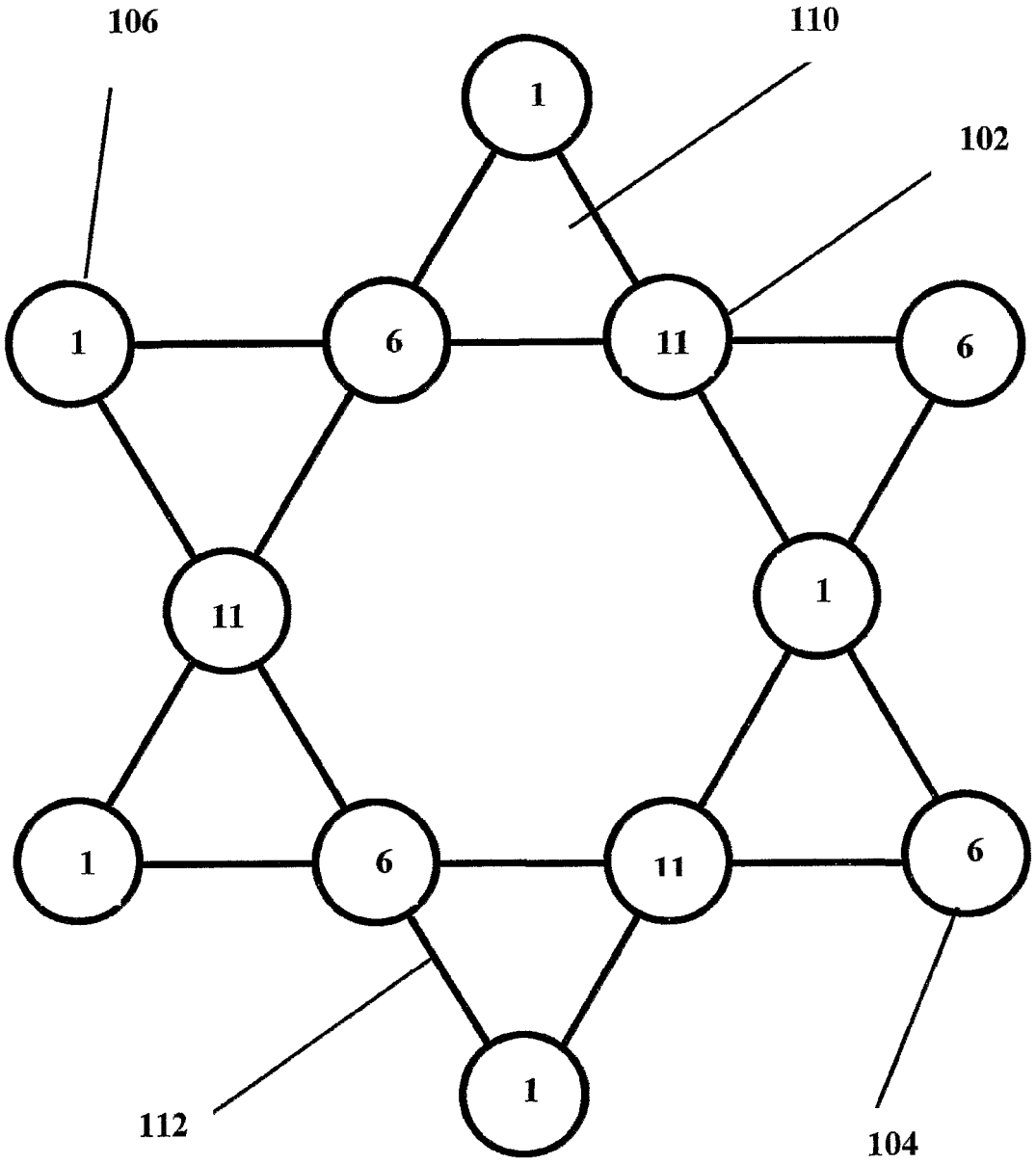

FIG. 4*c* A hexagram graph with elements arranged to have a sum of 18 for every number triplet disposed on a corner triangle pattern.

Figure 4D:
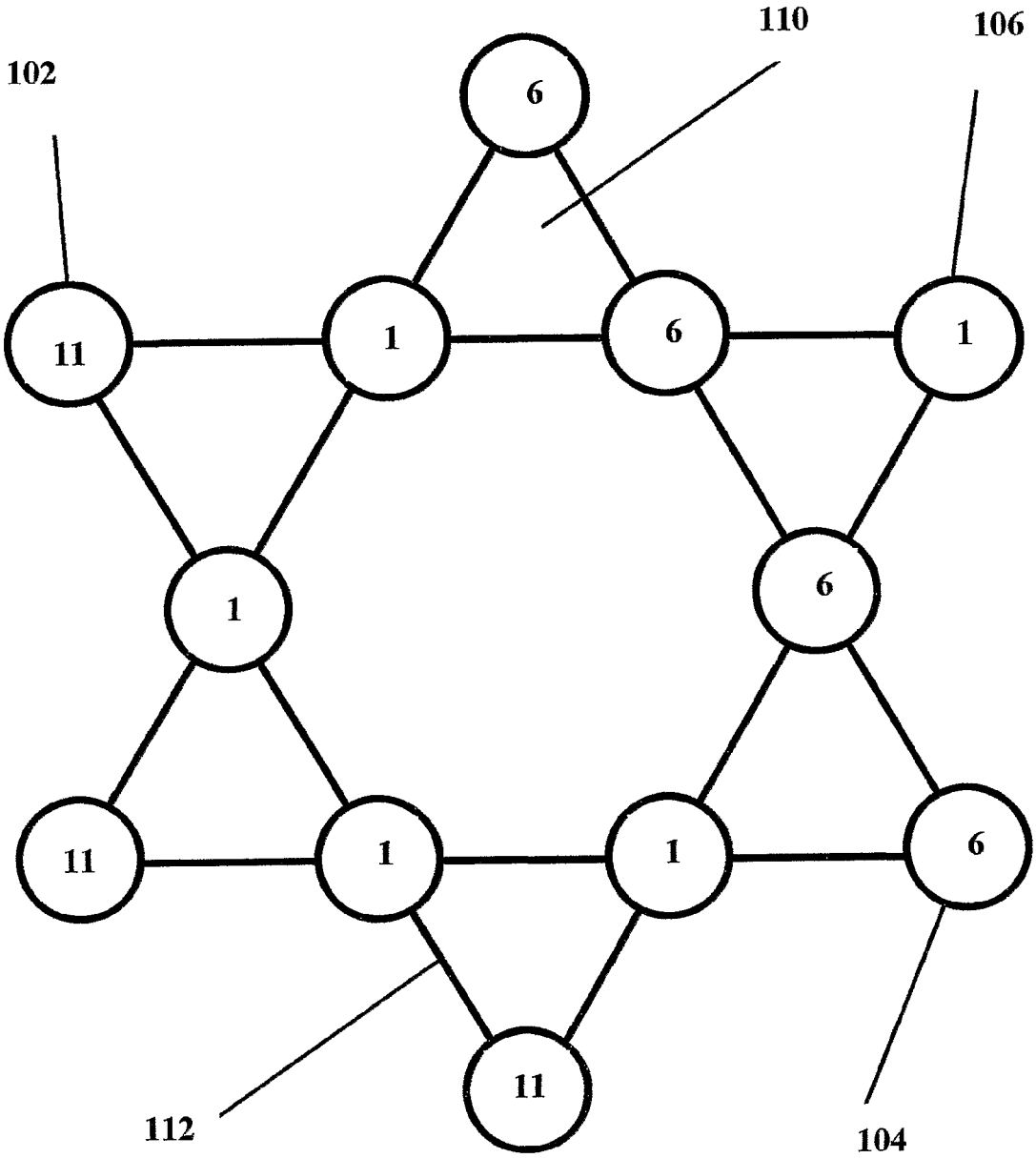

FIG. 4*d* A hexagram graph with elements arranged to have a sum of 13 for every number triplet disposed on a corner triangle pattern.

A Fourth Preferred Embodiment: Israel $60^{th}$ Anniversary Magic Square

Figure 5A:
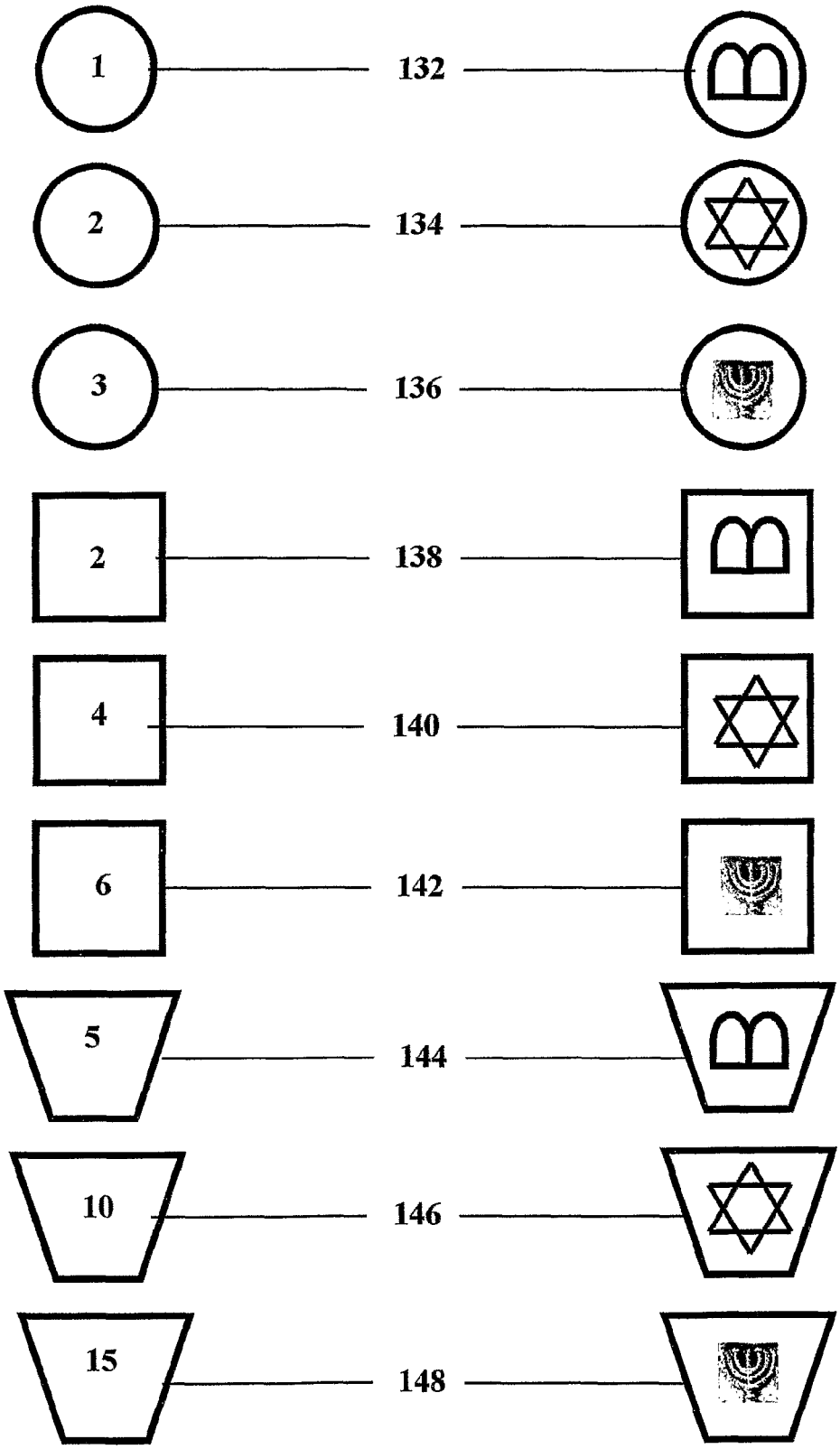

FIG. 5*a* A set of nine flat elements with shape and symbol indices on one side(right) and shape and number indices on the second side(left).

Figure 5B:
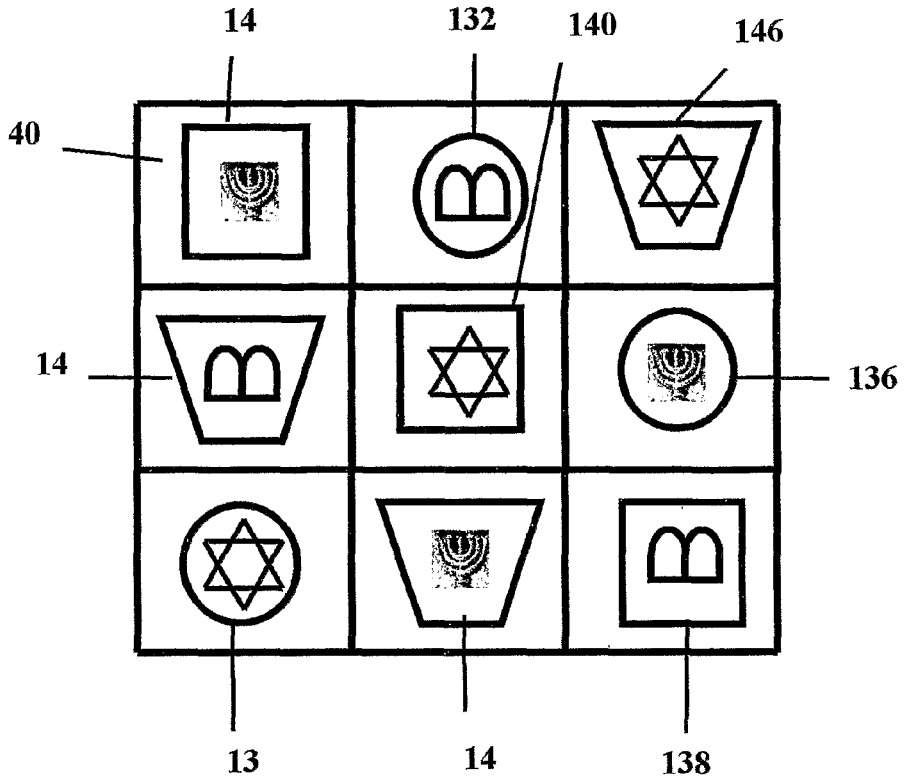

FIG. 5*b* A 3×3 square diagram with shape and symbol Graeco-Latin arrangement.

Figure 5C:
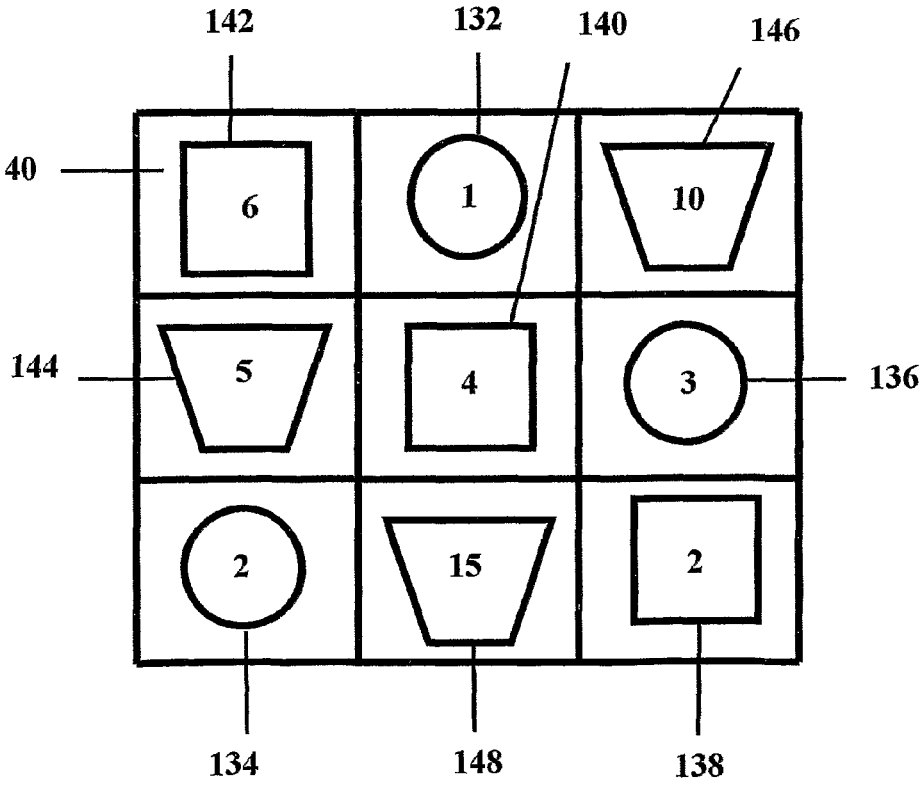

FIG. 5*c* The 3×3 square diagram with element shape and number index side up, having a product of 60 for the numbers on each row or column pattern.

DESCRIPTION OF PREFERRED EMBODIMENTS

A first preferred embodiment is a sweet sixteen tri-trapezoid puzzle gift, composed of a background and nine flat elements. FIG. 2*a* shows the background, a tri-trapezoid graph 40 with six vertex nodes 44 and three valley nodes 46. FIG. 2*b* presents the nine elements 51-59, on which indices of three types are disposed: number type, texture type and shape type. The shapes are a star, a heart, a triangle and a disk. The texture indices are vertical lines, diagonal lines, horizontal lines, and blank. FIG. 2*b* shows every element of the nine elements 51-59 twice, shape index and texture index in the right hand side, shape index and number index in the left hand side. The number index is the sum of a number matching the shape index and a number matching the texture index. The numbers 0,1,2,3 match the vertical lines, diagonal lines, horizontal lines, and blank textures, respectively. The numbers 0, 2,3, 5 match triangle, disk, heart, and star shapes, respectively.

The sweet-sixteen tri-trapezoid puzzle gift recipient is instructed to dispose the nine elements on the nine nodes in a shape and texture Graeco-Latin arrangement with regard to the trapezoid patterns. FIG. 2*c* shows a possible arrangement of elements 51-59 satisfying a first relationship of a Graeco-Latin arrangement. Once the recipient overcomes that moderate challenge and gets the desired arrangement, she is instructed to reverse the nine elements to their other side. As shows FIG. 2*d*, she surprisingly gets that the sum of numbers disposed on all elements of each trapezoid pattern is 16. Thus, a second relationship is fulfilled by the same arrangement.

There are 4×4=16 different combinations of the shape and texture indices. Therefore, in an embodiment of smaller challenge, up to seven elements are provided in addition to said nine elements. The additional elements are indexed with other shape and texture combinations, and their addition relaxes the challenge of getting Graeco-Latin arrangement, while still satisfying the second relationship of having 16 as the sum number.

Color, rather than texture, might make the gift more vivid. Thus, in another embodiment, red, green, blue and white indices might replace vertical lines, diagonal lines, horizontal lines, and blank texture indices, respectively.

In yet another embodiment a sum or product number is selected out of the group consisted of 20,25,30, 40,50, 60; or 75. It may be used as a gift item for people celebrating appropriate birthday or marriage anniversary.

FIG. 3 shows a second preferred embodiment, a 7-eleven magic star puzzle game. FIG. 3*a* depicts a heptagram graph 80 with seven valley nodes 82, seven vertex nodes 84, and connecting lines 86. A set of 14 numerical indexed elements is composed of six 1-indexed elements, four 5-indexed elements and four 9-indexed elements. The player is instructed to dispose the elements on the heptagram nodes so that seven corner triangle patterns of the heptagram would be characterized by having a first relationship of having a sum of eleven, for every number triplet on the elements disposed on the patterns. In FIG. 3*a*, a first arrangement satisfying that instruction is shown, defining a first magic heptagram. The $7^{th}$ order of the heptagram star is a symbolically significant content in connection to American "7-eleven" store network. The sum number of eleven is also a symbolically significant content in connection to that name. Namely, the symbolically significant content of the graph shape is connected to the symbolically significant content of the first relationship. This content connection makes a game of finding the first arrangement a possible promotion for "7-eleven".

The 7-eleven magic star game may be produced quite cheaply by printing the heptagram on a cardboard package of a popular consumer product, cereal for example, and placing a bag of sol-made number-indexed-elements inside the cardboard package. In an even cheaper embodiment, the elements are printed on the cardboard package as well, and the consumer should get them out using scissors.

The 7-eleven magic star game may be enriched in challenge by asking a player to re-dispose the 14 elements in a second arrangement in order to get a sum of 15, rather than eleven, upon addition of the number triplet which appears on the three elements disposed on each of the seven corner triangle pattern. A possible second arrangement obeying such a second relationship is shown in FIG. 3*b*. Actually, it is a Latin arrangement of the numbers 1, 5 and 9 over the triangle patterns.

A third preferred embodiment of the present invention, a Bar-mitzvah magic Solomon seal, is presented in FIG. 4. FIG. 4*a* shows a set of 12 flat numerically indexed elements of three kinds, three elements 102, four elements 104, and five elements 106, all with their numerical side up. FIG. 4*b* shows the three element kinds 102, 104, and 106 with their symbolic side up. The symbols are Jewish religious symbols: the Ten Commandments board outline, a Temple Menorah, and the Star of David hexagram, also called Solomon Seal. FIG. 4*c* shows a hexagram graph 110 with 12 nodes and with connecting lines 112, whereas said elements being disposed on said 12 nodes in a first arrangement which defines a first magic hexagram so that six corner triangle patterns of the magic hexagram are characterized by having a first relationship that every sum of a number triplet on the elements disposed on each corner triangle pattern equals 18, a lucky number resembling life in Jewish tradition. The player may get that arrangement by having the elements on their symbolic side, disposed in a symbol Latin arrangement over the corner triangle patterns.

FIG. 4*d* shows the hexagram graph 110 wherein said elements are disposed in a second arrangement which defines a second magic hexagram, so that six corner triangle patterns of the magic hexagram are characterized by having a second relationship, that every sum of a number triplet on elements disposed on each corner triangle pattern equals 13, the maturing Bar-Mitzva age of a Jewish boy. As mentioned, hexagram is the famous David star symbol. Thus, each of the members of a group composed of the hexagram graph, the symbol type of indices, the first relationship, and the second relationship, represent symbolically significant content, whereas the symbolically significant content of each of the members is culturally connected to the symbolically significant content of the other members of the group.

The hexagram shape is widely used as an ornament. This makes a room for a preferred embodiment of a boy ornament Bar-mitzvah magic Solomon seal. Here, spheric elements, each with two appropriate numbers disposed on two opposing hemispheric surfaces should be disposed in the appropriate hexagram nodes so that the first arrangement of 18 as sum number is seen from one side of the ornament and the second arrangement of 13 as sum number is seen from the second side of the ornament. The elements are removable in the production phase while afterwards the elements are locally fixed. Rotationally, the elements are either free under slight torque, imposing a challenge to the gift recipient to bring them to the right position, or fixed, saving the challenge. The free rotation design is suitable for a plastic toy as well as for an ornament.

Similarly, a girl ornament embodiment is obtained by replacing 13 of the boy ornament by 12, a Jewish girl Bat-mitzvah maturity age. For this, the ornament should be designed with the number indices 0, 6, and 12, respectively, replacing 1, 6, and 11 of the Bar-mitzvah magic Solomon seal.

A fourth preferred embodiment of the present invention, presented in FIG. 5, is Israel $60^{th}$ anniversary magic square. FIG. 5*a* shows a set of nine flat elements 132-148 having shape and symbol indices on one side(right) and shape and number indices on the second side(left). FIG. 5*b* depicts a 3×3 square diagram 40, having nine sites, with the nine elements 132-148 disposed on the nine sites with their shape and symbol indices side up. This arrangement defines a magic square so that row and column patterns of the magic square have a first relationship of a Graeco-Latin arrangement. FIG. 5*c* shows the 3×3 square diagram 40 with the same arrangement of said nine elements but with their shape and number indices side up, showing that the magic square have a second relationship that row and column patterns of the magic square have a product of 60 upon multiplication of the numbers on all the elements disposed on each pattern.

The Israel $60^{th}$ anniversary magic square game is most suitable to be sold as a souvenir to citizens, sympathizers and visitors of Israel, between Israel $59^{th}$ and $61^{st}$ independence day. The player may try to obtain the second relationship of 60 product, using Latin shape arrangement over row and column pattern as a clue. Alternatively, the player may try to achieve the Graeco-Latin relationship and upon element reversion he may surprisingly realize that the 60 product relationship is automatically obtained. In any case, the challenge is quite minor, but still provides a minute or two of entertainment, leaving the focus at the souvenir content, Israel $60^{th}$ anniversary celebration.

Although the description above contains many specificities, these should not be construed as limiting the scope of the invention but as merely providing illustrations of some of the presently preferred embodiments of this invention. Thus the scope of the invention should be determined by the appended claims and their equivalents, rather than by the examples given.

What is claimed is:

1. A puzzle game comprising:

a) a background defining a graph having a plurality of nodes connected by a plurality of lines;

b) three or more patterns of nodes of said graph, each pattern:

(i) having a first number of nodes; and (ii) consisting a continuous and closed series of adjacent nodes of that pattern, whereas a line connects each pair of adjacent nodes of that pattern; and c) a plurality of numerically indexed elements of a number of index kinds of respective distinct numerical indices, said number equaling said first number, each index kind having at least three numerically identical elements, the numerically indexed elements being disposable on the graph nodes; and (d) said three or more patterns and said numerically indexed elements enabling:

(A) a first arrangement of at least major portion of said plurality of numerically indexed elements on said graph nodes, the sum of the elements disposed on the nodes of each pattern of said three or more patterns consisting a continuous and closed series of adjacent nodes being a first same sum for each pattern; and (B) a second different arrangement of at least major portion of said plurality of numerically indexed elements on said graph nodes, the sum of the elements disposed on the nodes of each pattern of said three or more patterns consisting a continuous and closed series of adjacent nodes being a second same sum for each pattern, said second same sum being different from said first same sum, wherein a player obtains one arrangement with a certain same sum, and then rearranges elements to get a different arrangement having another and different same sum.

2. The puzzle game of claim 1, wherein said first number of nodes is three or four.

3. The puzzle game of claim 1, wherein said graph is selected from a group consisting of a pentagram, a hexagram, and a heptagram.

4. The puzzle game of claim 1, wherein a same sum is a number of significance for a certain group of people, and the game is offered for sale to people associated with said certain group.

5. The puzzle game of claim 1, wherein a same sum is selected out of the group consisting of 12, 13, 16,18, 20,25, 26, 30,40,50, 60, and 75.

6. The puzzle game of claim 1, wherein one arrangement is a Latin arrangement of said plurality of indices over the pattern nodes.

7. The puzzle game of claim 1, wherein said graph is a tri-trapezoid shape.

8. The puzzle game of claim 1, wherein said elements are substantially spherical shaped elements, each element is locally fixed to certain node, and each element is free to rotate under application of some torque.

9. The puzzle game of claim 1, wherein the game is implemented on one platform of a group of computerized platforms consisting of an electronic game apparatus, a computer system, a cellular phone, and an internet site.

* * * * *